US010729213B2

(12) United States Patent
FitzPatrick et al.

(10) Patent No.: US 10,729,213 B2
(45) Date of Patent: Aug. 4, 2020

(54) FOLDING CANE

(71) Applicant: Avenue Mobility Ltd, Stamford, CT (US)

(72) Inventors: Helen Ix FitzPatrick, Greenwich, CT (US); Geri W. Roper, Greenwich, CT (US); Kenneth A. Tarlow, San Rafael, CA (US)

(73) Assignee: AVENUE MOBILITY LTD., Stamford, CT (US)

( * ) Notice: Subject to any disclaimer, the term of this patent is extended or adjusted under 35 U.S.C. 154(b) by 0 days.

(21) Appl. No.: 16/368,083

(22) Filed: Mar. 28, 2019

(65) Prior Publication Data

US 2019/0298015 A1 Oct. 3, 2019

Related U.S. Application Data

(60) Provisional application No. 62/649,653, filed on Mar. 29, 2018.

(51) Int. Cl.

| | |
|---|---|
| ***A45B 9/00*** | (2006.01) |
| ***A45B 7/00*** | (2006.01) |
| *A45B 9/04* | (2006.01) |

(52) U.S. Cl.

CPC ..... *A45B 9/00* (2013.01); *A45B 7/00* (2013.01); *A45B 9/04* (2013.01)

(58) Field of Classification Search

CPC ..... A45B 9/00; A45B 9/04; A45B 2009/007; A45B 2009/005; A45B 2200/055; A45B 19/08; A45B 7/00

USPC ..... 135/65–66, 68, 74

See application file for complete search history.

(56) References Cited

U.S. PATENT DOCUMENTS

| | | | | | |
|---|---|---|---|---|---|
| 911,636 | A * | 2/1909 | Whitlock | A45B 25/143 | 135/22 |
| 3,187,373 | A * | 6/1965 | Fisher | E05D 11/1007 | 16/324 |
| 4,437,480 | A * | 3/1984 | Husa | A61H 3/02 | 135/74 |
| 4,527,579 | A * | 7/1985 | Knotter | A45B 9/00 | 135/74 |
| 4,747,423 | A * | 5/1988 | Hansen | A61H 3/02 | 135/68 |
| 6,740,054 | B2 * | 5/2004 | Stearns | A61F 5/0123 | 602/16 |
| 6,920,888 | B2 * | 7/2005 | Ko | A01B 1/16 | 135/65 |

(Continued)

*Primary Examiner* — Winnie Yip

(74) *Attorney, Agent, or Firm* — Wissing Miller LLP

(57) ABSTRACT

A folding cane with a first shaft member, a second shaft member, a third shaft member, a handle member, a foot member, a first hinge, a second hinge, a first hinge lock assembly and a second hinge lock assembly is disclosed. The handle member is attached to the top of the first shaft member. The first hinge member connects the first shaft member to the second shaft member. The second hinge member connects the second shaft member to the third shaft member. The foot member is attached to the bottom of the third shaft member. The hinge lock assemblies are capable of automatically locking the hinges when the folding cane is deployed to the use position and each hinge lock assembly includes a spring biased slide tab allowing a user to unlock the hinge lock assemblies when wanting to fold the cane into a compact stored configuration.

11 Claims, 6 Drawing Sheets

(56) References Cited

U.S. PATENT DOCUMENTS

| | | | | |
|---|---|---|---|---|
| 7,131,166 | B2 * | 11/2006 | Cohen | A63C 11/221<br>16/232 |
| 9,456,671 | B2 * | 10/2016 | Crowhurst | A45B 9/04 |
| 9,752,364 | B2 * | 9/2017 | James | E05D 11/1014 |
| 10,258,533 | B1 * | 4/2019 | Chu | A61H 3/02 |
| 2019/0208874 | A1 * | 7/2019 | Ritter | A45B 9/00 |

* cited by examiner

FOLDING CANE

CROSS REFERENCE TO RELATED APPLICATIONS

This application claims priority under 35 U.S.C. § 119 to U.S. Provisional Patent Application No. 62/649,653, filed on Mar. 29, 2018. The disclosure of that application is incorporated herein by reference.

FIELD OF THE INVENTION

This invention relates generally to the field of walking canes and more specifically to a folding cane whose shaft members automatically lock when in the use position.

BACKGROUND

Walking canes are well known and used by people who need a degree of assistance while walking, especially on uneven terrain. They traditionally consist of a rigid shaft terminating at the top end in a handle and at the bottom end in a resilient foot. In order to make canes easier to store and transport when not in use, some manufacturers have designed canes that are made of a plurality of hollow shaft pieces which are connected to each other by an elastic cord located within the hollow portion of each shaft member. Each shaft member includes a reduced diameter bottom end that can slide into the normal diameter of the top end allowing the shaft members to become parallel with each other and forming one continuous shaft that is used as a cane. Although the ability to fold the cane is advantageous, there can be difficulty when the user wants to pull the shaft pieces apart because the smaller diameter end of one shaft piece can frictionally lodge itself into the larger diameter end of the adjoining shaft piece making the shaft pieces difficult to detach from each other. This is especially true when the user has arthritis or another ailment that may reduce his or her physical ability to detach the shaft pieces from each other. Additionally, there is no easy way to hold the folded pieces together because the elastic cord does not provide a stable hinge point for the shaft pieces to automatically rest next to each other when folded, thereby causing potential inconvenience to the user or causing the user to need an additional strap or enclosure to retain the folded cane.

SUMMARY

One object of the disclosure is to provide a cane that includes hinged joints enabling the cane to fold to approximately thirty-three percent of its normal size.

Another object of the disclosure is to provide a folding cane whose hinged joints include an automatic locking mechanism that ensures that the cane members remain in proper orientation to each other during use.

Another object of the disclosure is to provide a folding cane whose locking members can be easily unlocked by the user when the user wishes to fold the cane into the stored condition.

Another object of the disclosure is to provide a folding cane whose shaft portions become adjacent to each other when folded and can be held in the folded condition by use of magnets imbedded into the side walls of the shaft portions.

Other objects and advantages of the present invention will become apparent from the following descriptions, taken in connection with the accompanying drawings, wherein, by way of illustration and example, an embodiment of the present invention is disclosed.

In accordance with a preferred embodiment, there is disclosed a folding cane comprising: a first shaft member, a second shaft member, a third shaft member, a handle member, a foot member, a first hinge, a second hinge, a first hinge lock assembly and second hinge lock assembly, said handle member attached to the top of said first shaft member, said first hinge member connecting said first shaft member to said second shaft member, said second hinge member connecting said second shaft member to said third shaft member, said foot member attached to the bottom of said third shaft member, said first and second hinge lock assemblies capable of automatically locking said hinges when said folding cane is deployed to the use position, and said first and second hinge lock assemblies each including a spring biased slide tab allowing a user to unlock said hinge lock assemblies when wanting to fold said cane into a compact stored configuration.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
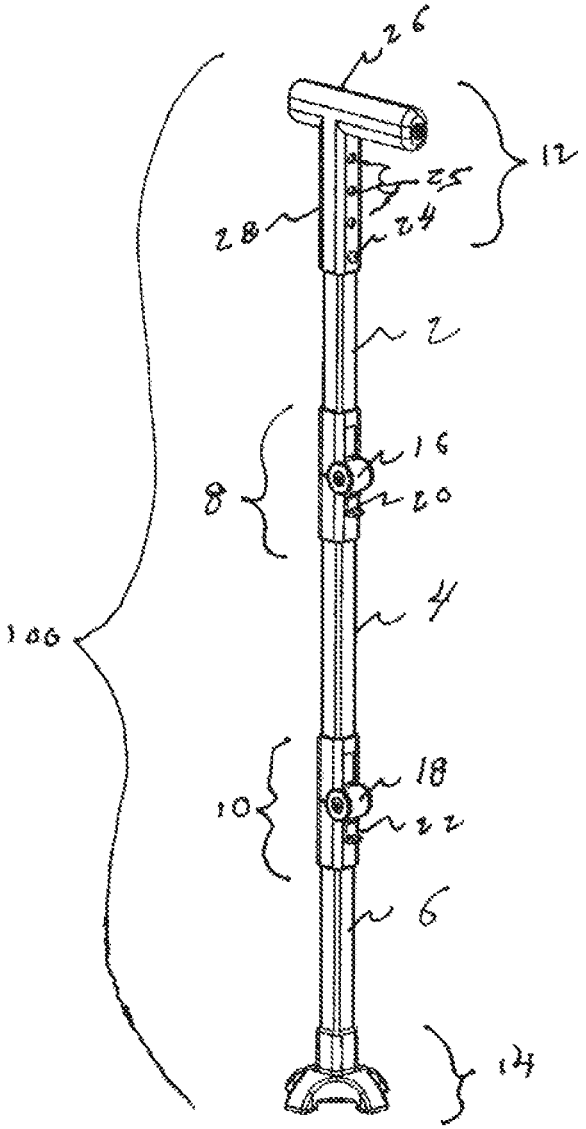
FIG. 1 is a perspective view of an embodiment of the disclosure.

Referring now to FIG. 1 we see a perspective left side view of the cane 100 in the deployed position ready to use as a standard walking cane. A first shaft member 2 is connected to a second shaft member 4 by hinged assembly 8. The second shaft member 4 is attached to a third shaft member 6 by hinged assembly 10. A handle 12 is comprised of a horizontal handle portion 26 attached to a vertical connection portion 28 which slidably attaches to first shaft member 2 and is retained in place by locking button 24 as it enters one of the apertures 25. Slide tabs 20, 22 can unlock the hinge members 16, 18 as will be described below and illustrated in subsequent FIGS. 3, 4, 5 and 6. Resilient tip 14 attaches to the bottom of the third shaft member and includes a spread foot design giving the cane 100 more stability when in use and also allowing the cane to stand upright by itself when not in use. In this embodiment, the cane is comprised of three shaft members joined by two hinge assemblies. A greater or fewer number of shafts and hinge assemblies can be provided within the scope of the disclosure.

Figure 2:
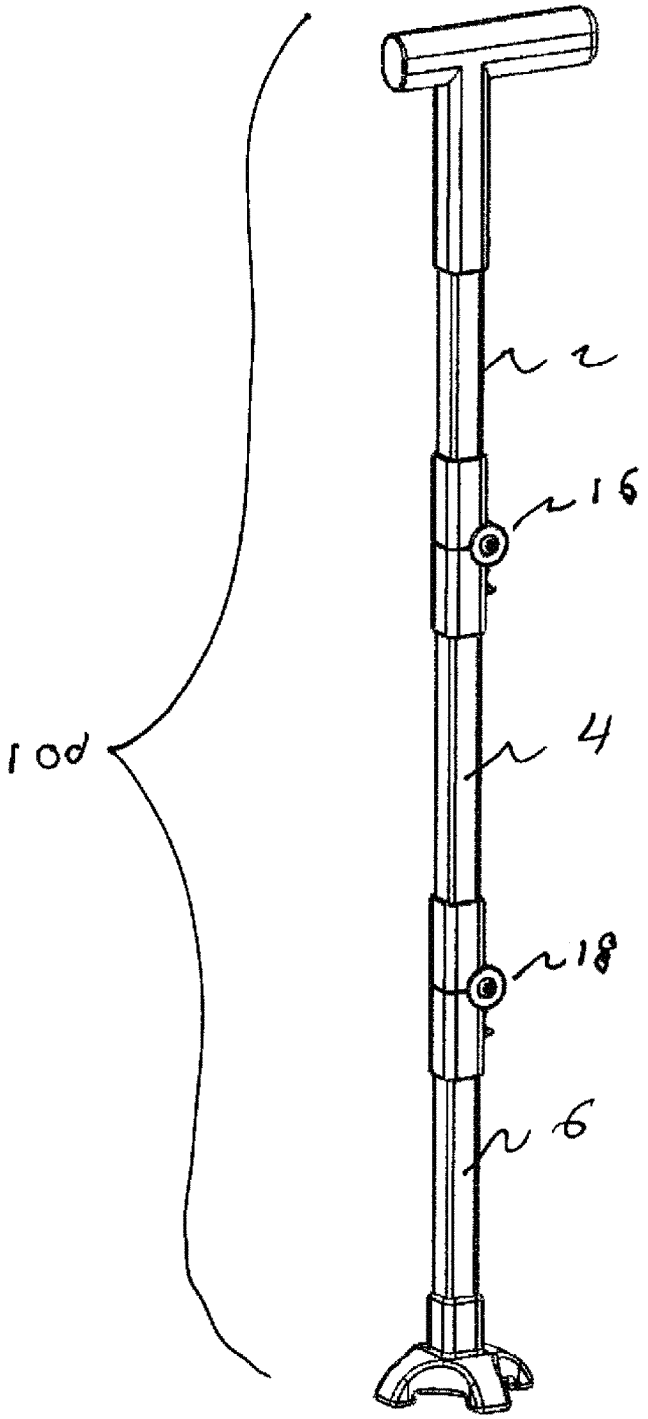
FIG. 2 is a side view of the embodiment of FIG. 1.

FIG. 2 is a perspective right side view of the cane 100 in the deployed position.

Figure 3:
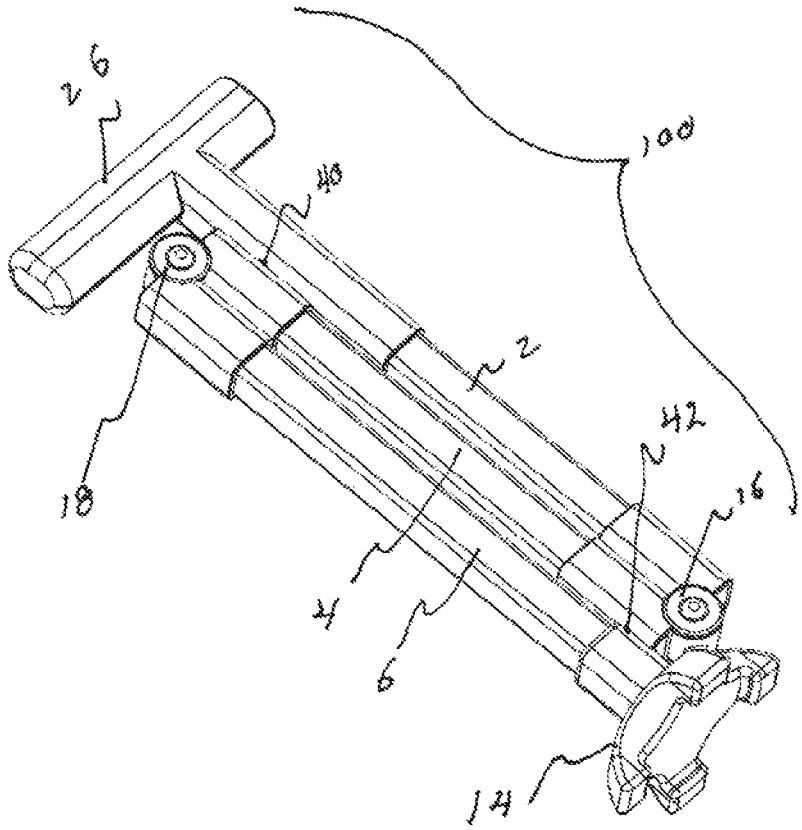
FIG. 3 is a perspective view of the embodiment of FIG. 1 in the folded position.

FIG. 3 is a perspective view of the cane 100 in the folded position. The overall length of the folded cane is approximately thirty-three percent of the fully extended cane. The shaft members 2, 4, 6 are located directly adjacent to one another. Optional magnet members can be placed between the shaft members at locations 40 and 42 to allow the shaft members 2, 4, 6 to remain in close proximity to each other until the user decides to unfold the cane 100 for use.

Figure 4:
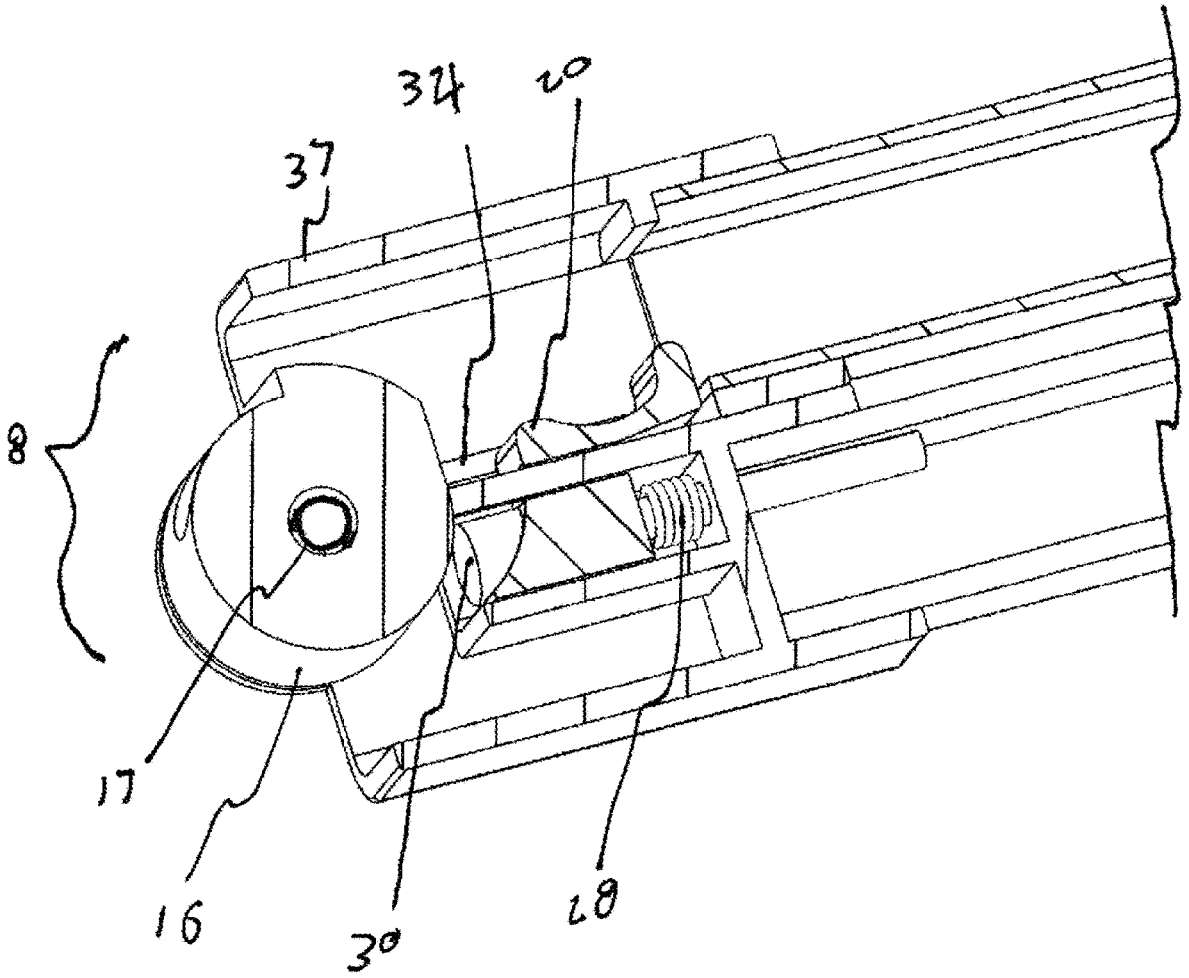
FIG. 4 is a section view of the locking mechanism in the unlocked and folded position.

FIG. 4 is a section view showing the hinge locking mechanism in the folded position. The slide tab 20 is residing in a cutout portion 34 of the molded tube holding member 37. The tip of post 30 is disengaged from aperture 32 shown in FIG. 6 and can ride along the outside perimeter of hinge member 16. Spring 28 is compressed. Preferably, all hinge components and sockets that join the hinges to the shafts are made of injection molded glass filled nylon. However, other strong materials may be considered for the application such as carbon fiber.

Figure 5:
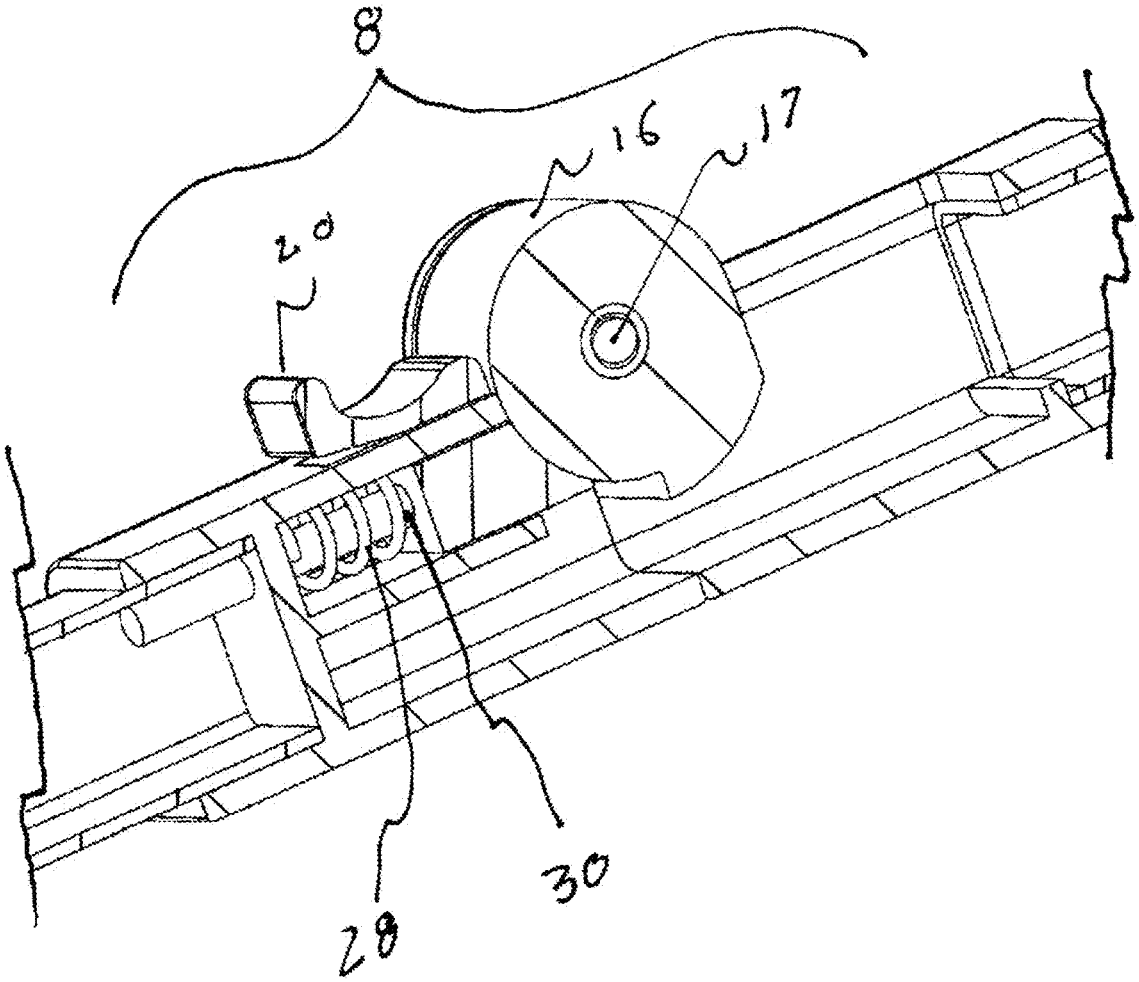
FIG. 5 is a section view of the locking mechanism in the locked and in use position.

FIG. 5 is a section view of the shaft members in the use position. Post 30 has entered aperture 32 causing hinge member 16 to be locked.

Figure 6:
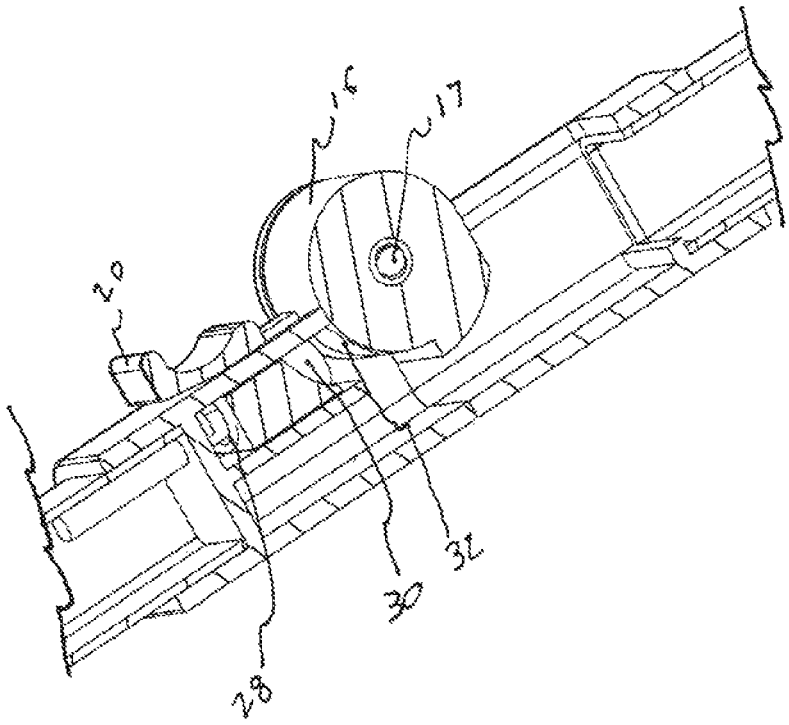
FIG. 6 is a section view of the locking mechanism with the slide tab being pulled back to unlock the hinge portion.

FIG. 6 is a section view of the shaft members in the use position with the slide tab 20 pulled back thereby removing post tip 30 from aperture 32 allowing the hinge member 16 to rotate into the stored position.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A folding cane comprising:

a first shaft member;

a second shaft member;

a handle member;

a first hinge comprising a radial surface and a locking aperture disposed in the radial surface; and a first hinge lock assembly comprising a post, a tab connected with the post, and a bias spring adapted to apply a bias force to drive the post in a first direction toward the radial surface, wherein said handle member is attached to the top of said first shaft member, wherein said first hinge connects a bottom end of said first shaft member to a top end of said second shaft member, and wherein, when the first and second shaft members are aligned in a use position the post is aligned with the aperture and the bias force drives the post into the aperture to engage the post and aperture to prevent rotation of the first hinge to hold the first and second shaft members in alignment, and wherein the first hinge lock assembly further comprises a slide tab adapted to disengage the first hinge lock assembly, allowing the hinge to rotate and allowing a user to fold said cane into a compact stored configuration.

2. The folding cane of claim 1, further comprising a third shaft member, a second hinge and a second hinge lock assembly, wherein the second hinge connects a top end of the third shaft member with a bottom end of the second shaft member, and wherein the second hinge lock assembly locks the second hinge from rotation when the cane is in the use position.

3. The folding cane of claim 1, wherein the handle comprises a plurality of engagement holes, vertically spaced from one another, wherein the first shaft member comprises an engagement tab positioned to engage with a selected one of the engagement holes, and wherein a length of the folding cane is determined by the selected engagement hole.

4. The folding cane of claim 1 wherein said shaft members are made of hollow rigid tubing.

5. The folding cane of claim 1 wherein said first hinge comprises:

a cylindrical portion with a centrally located aperture connected with one of the first and second shaft members; and a central pin portion connected with the other of the first and second shaft members, wherein said central pin portion rotatably engages the centrally located aperture in said cylindrical portion.

6. The folding cane of claim 1, wherein pulling the sliding tab in a second direction pulls the post from the aperture, unlocking the hinge and allowing the hinge to rotate to move the cane from the use position toward a compact storage position.

7. The folding cane as claimed in claim 1 wherein said hinges and said hinge lock assemblies are injection molded from glass reinforced nylon plastic.

8. The folding cane of claim 1, further comprising first and second storage latch assemblies disposed on the respective first and second shafts, the first and second storage latch assemblies removably holding the first and second shafts adjacent one another when the cane is in a compact storage position.

9. The folding cane of claim 8, wherein the first and second storage latch assemblies comprise a magnet and a ferromagnetic surface positioned on respective ones of the first and second shaft members, wherein the latch assemblies are adjacent one another when the cane is in the compact storage position.

10. The folding cane of claim 1, further comprising a foot member attached to a bottom end of the second shaft member.

11. The folding cane of claim 10, wherein the foot member comprises a spread foot.

* * * * *